US005205787A

United States Patent [19]

Simoneau

[11] Patent Number: 5,205,787

[45] Date of Patent: Apr. 27, 1993

[54] FORM FOR RECORDING ORDER AND DELIVERY INFORMATION

[76] Inventor: James N. Simoneau, 32901 Blossom Ct., Birmingham, Mich. 48025

[21] Appl. No.: 861,289

[22] Filed: Mar. 31, 1992

[51] Int. Cl.[5] ..... B42D 15/00

[52] U.S. Cl. ..... 462/56; 462/17; 283/63.1; 281/38

[58] Field of Search ..... 462/56, 75, 25, 26, 462/2, 17; 283/63.1; 281/38

[56] References Cited

U.S. PATENT DOCUMENTS

| | | | |
|---|---|---|---|
| 1,079,737 | 11/1913 | Bannerman | 462/56 |
| 2,089,247 | 8/1937 | Benson | 462/56 |
| 4,191,402 | 3/1980 | Michlin | 283/63.1 |
| 4,502,712 | 3/1985 | Malone | 462/75 X |

*Primary Examiner*—Mark Rosenbaum
*Assistant Examiner*—William Fridie, Jr.
*Attorney, Agent, or Firm*—Harness, Dickey & Pierce

[57] ABSTRACT

A form for recording information for preparing and delivering a food-type order, such as an order for pizza and the like food and non-food items, comprises a stack of pressure sensitive copy sheets that are joined together along a common edge. Aligned columns are formed upon the sheets to provde overlapped spaces for receiving written information such as the items ordered, prices, delivery addresses and the like. At least some of the sheets are cut transversely to the common edge to form sets of overlapped, narrow, elongated strips, each having the information spaces. A delivery address space is provided adjacent the common edge and is of a length which is roughly twice the length used for recording address information. A tear line is formed on one of the sheets at the inner end of its address space to form a separable delivery tag. The delivery tag may be separated from its strip along the tear line and is folded into an upper, exposed flap bearing the delivery address and a lower, fastening flap adapted to be positioned beneath a wristband worn by the delivery person, or a similar band, with the remainder of that strip adapted to be used as a receipt positioned with the container for the order. Thus, the delivery address is readily available to the delivery person during the delivery operation.

10 Claims, 2 Drawing Sheets

FORM FOR RECORDING ORDER AND DELIVERY INFORMATION

BACKGROUND OF THE INVENTION

This invention relates to an improvement to a form used for controlling and recording and delivering food and the like orders normally received by telephone. The form is described in U.S. Pat. No. 4,191,402 issued Mar. 4, 1980 to Irving R. Michlin for a "Form for Control and/or Recording Purposes".

In the business of preparing and delivering food orders, such as orders for pizza and the like food items and, also non-food items, the customer usually calls the fast-food establishment and indicates the items ordered. That order may be oral or sent through a facsimile type device. On some occasions, an order may be given in person at the food establishment for customer take-out of the order. When the order information arrives at the food establishment, it is necessary to record the information so as to immediately prepare and assemble the items comprising each order, to determine the price thereof, and to provide the delivery person with the delivery address. Delivery of such orders by automotive vehicles or bicycles are conventional.

The form which is disclosed in the above-mentioned U.S. Pat. No. 4,191,402 comprises a multi-sheet form having a number of carbonless or pressure-sensitive copy paper sheets fastened together along one common edge. The uppermost sheet is monolithic and forms a permanent record of a number of orders, such as, for example, 10 orders. The sheets below the uppermost monolithic sheet are severed transversely of the fastened edge to provide a number of sets or groups of overlapped, elongated strips. By way of example, a set of three strips may be provided. The form may also include a lower, monolithic sheet for backup purposes and for holding the strips in place during use of the form.

In use, when an order is received, the order taker writes the information upon the uppermost, monolithic sheet. The information is automatically transmitted and recorded upon the sheets beneath it. Thus, the sheets are provided with printed columns to form aligned spaces for receiving specific information. For example, one space receives the list of items ordered; another space may receive special instructions or non-food items; another space may receive the delivery address and customer's phone number. The price, order number and the like may be written in other spaces.

After the information about an order is written, the set of strips or group of strips bearing that order may be removed from the form for processing. Suitable, perforated tear lines formed along the strip edges which are joined together at the common edge of the sheets facilitate removal of the sets of strips from the form. Then, the strips in the group or set may be separated for different purposes. For example, a cook in a pizza establishment may receive one strip for indicating the particular pizza ordered, another strip may go to a different person to provide drinks or other items, etc.

Typically, one of the strips in each set has been used as an address label and receipt for the delivery of the order to the customer. In that case, that strip has been fastened, such as by adhesive tape or stapling, or otherwise carried with the container within which the order is handled. The delivery person then takes the container and delivers it to the customer, relying upon the address information that appears on the strip associated with that particular container.

In the case of hot food deliveries, such as pizza, it is common to place the food items ordered in a paper bag or cardboard container and then to carry that within an insulated container for delivery. Upon delivery, the delivery person removes the inner container, within which the food container is packaged, and retains the insulated container for reuse. In those instances, the delivery address information, which is written on the strip associated with the order, is located within the insulated container and, therefore, the delivery person must either memorized the address in advance of placing the contained order within the insulated container or must, from time to time, open the insulated container and look at that address. Where the order container is not placed within an insulated container, the strip bearing the address may be arranged with the container near the delivery person, such as on the passenger seat of an automobile.

To check the address written upon the strip, the delivery person must look into the insulated container or at the packaging container, such as the bag or box containing the food. Consequently, his eyes are diverted from the roadway for a short time. At times, this could be hazardous, particularly in areas where there are relatively considerable amounts of traffic or road obstacles or other difficult driving conditions. It would be desirable to eliminate the need for the delivery person to momentarily takes his eyes off the road in order to check the delivery address.

Hence, this invention relates to an improved delivery form wherein the address information may be severed from the delivery receipt strip to provide a separate tag that is positioned upon the delivery person's wrist or upon some other readily available place for instant view by the delivery person.

SUMMARY OF THE INVENTION

This invention contemplates repositioning the address space on the strips which are formed on a multi-sheet control and delivery form so that the address information is arranged along one edge of one of the strips, which would otherwise be used as a receipt, to provide an address tag. The address tag may be severed, along a tear line, from its strip. The address information is written along approximately one-half of the tag length. The tag may then be folded, roughly in half, to provide an exposed upper flap upon which the address information appears, and a lower flap which may be inserted beneath a band worn on the delivery person's wrist or upon some other suitable items such as a band around the steering wheel of a vehicle or the handle bar of a bicycle. Thus, the address, at all times, is readily visible to the delivery person during the delivery operation.

By relocating the conventional space utilized for recording the customer's delivery address to one side or edge of the delivery receipt slip and by utilizing part of that address space for the address and the remainder of that address space to form a fastening flap, the delivery person may look at an address without having to divert his eyes from the road for any material length of time. Thus, an object of this invention is to provide a separable, address delivery tag which is automatically prepared while taking the order and recording it upon the otherwise commercially available form. The tag location permits it to be severed from a strip which is part of the form so that the remainder of that strip may be used as a receipt.

Another object of this invention is to provide a means for providing the delivery person for a food and the like order with the delivery address tag that may be used without requiring the delivery person to take his eyes off the road more than momentarily or to look for address information within or upon the order container.

Still a further object of this invention is to expedite the delivery of an order by modifying a conventional order form so that a portion of it becomes a separable delivery address tag which is formed for attachment to either a wristwatch band worn by the delivery person or some other suitable band on an object located in front of the delivery person, such as a steering wheel of a vehicle or the handle bar of a bicycle.

These and other objects and advantages of this invention will become apparent upon reading the following description of which the attached drawings form a part.

DETAILED DESCRIPTION OF THE PREFERRED EMBODIMENT

Figure 1:
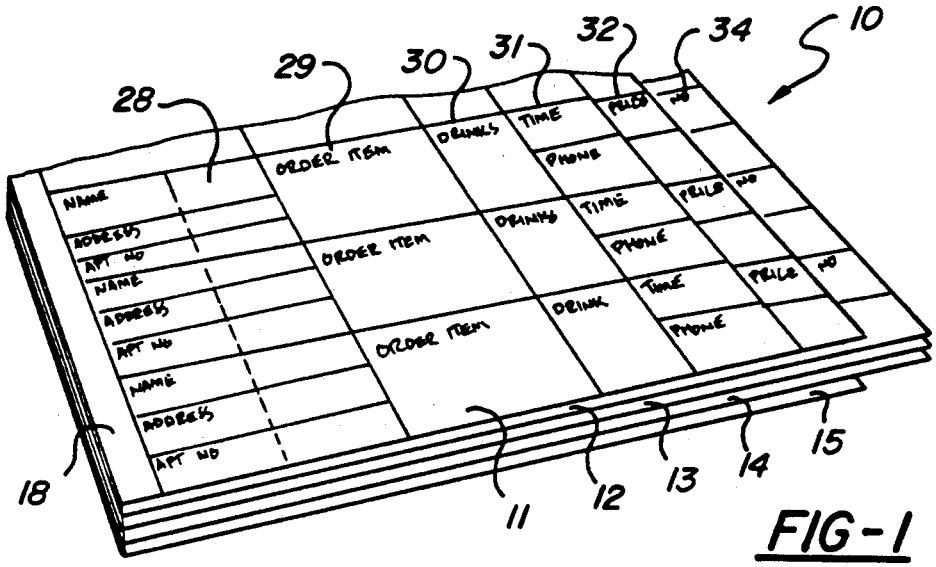
FIG. 1 is a schematic, perspective view of a portion of the multi-sheet form.
Figure 2:
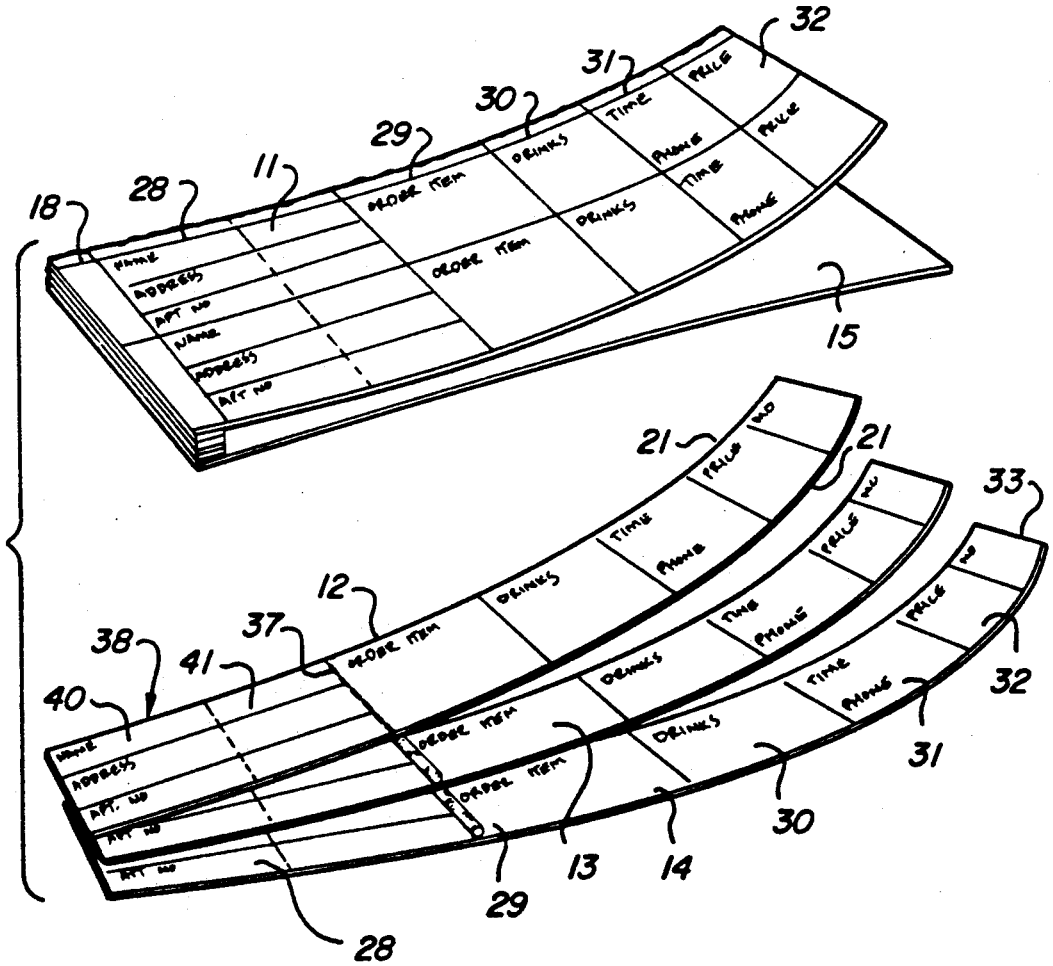
FIG. 2 is a perspective, schematic view of a portion of the form with a set or group of strips removed from the form.

FIG. 1 schematically illustrates a portion of a multi-sheet form 10. The form may be of considerably greater length. But, for illustration purposes, a segment of the form is shown. The form may be similar to that illustrated in U.S. Pat. No. 4,191,402.

The form is made of a number of overlapped sheets of pressure sensitive data transmitting paper such as what is commonly called "carbonless" paper. The upper or outermost sheet 11 is monolithic, that is, it is a complete sheet. Beneath the upper sheet 11 are located a series of strip sheets 12, 13 and 14. Beneath the strip sheets, a backup sheet 15 is located. The number of strip sheets may be varied depending upon the intended use of the form.

Figure 3:
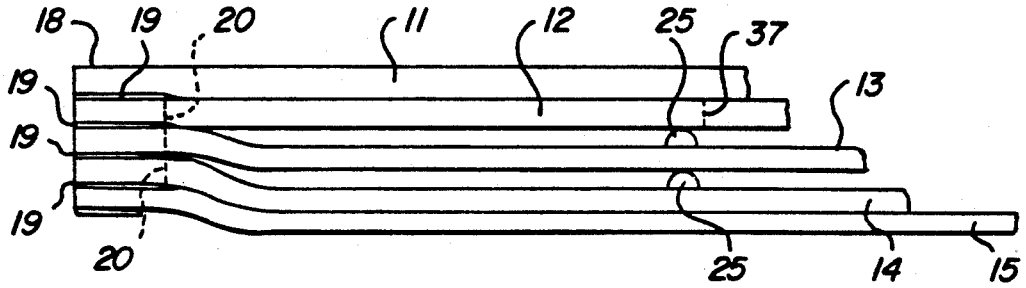
FIG. 3 is an enlarged, edge view of a fragment of the form showing the aligned sheets.

The sheets have a common edge strip portion 18. These edge portions are overlapped and adhesively secured together. FIG. 3 illustrates the adhesive 19 joining the sheets together along their common edges. The strip sheets are provided with perforated tear lines 20 (see FIG. 3) for readily tearing the sheets from their edge strips. In addition, each of the strip sheets is provided with a number of spaced apart, transverse cuts which provide a number of parallel narrow, elongated strips 12*a*, 13*a* and 14*a*, having elongated edges 21 on each of the stip sheets 12, 13 and 14, respectively. The overlapped strips provide sets or groups 24 of strips.

To hold the individual sets of strips together, adhesive 25 may be applied between the adjacent strips, as illustrated in FIG. 3. A suitable temporary adhesive material may be used so that the strips may be manually pulled apart, one from another, while otherwise being temporarily held together by the adhesive.

Numerous columns are printed upon the sheets to provide overlapping, aligned, information or data receiving spaces upon which predetermined data may be handwritten. The drawings illustrate information spaces arranged side by side along the length of the strips and the upper sheet. The lower sheet may or may not have such information spaces depending upon the intended use of the backup sheet.

By way of example, starting at the left side of FIG. 1 at the perforated tear lines 20, an elongated space 28 is provided for the name and address of the customer or addressee. Next, an order space 29 is provided for writing the items of the order. Next to that, a space 30 is provided for drinks or non-food items other than the ones mentioned in the space 29. Adjacent to that space is a space 31 for logging the time the order is received and the customer's phone number. This is particularly useful in cases where the food store indicates, such as through advertisements, that its delivery will be made within certain times following the receipt of a phone call. Next, a price space 32 is provided. On the strip sheets, an additional space 34 is provided for a number which may be the order number or may be the number corresponding to a particular sheet which then forms a store record of a predetermined number of transactions.

Significantly, the customer name and address space 28 is arranged along the extreme left side edge of the respective strips adjacent the tear lines 20. However, the columns could be printed to locate the address space on the extreme right side of the strip. In either event, the address is located along one end of the strip.

One of the strip sheets, such as strip sheet 12, is provided with perforated tear lines 37 to define the inner edge of the delivery address space 28. Thus, the tear line 37 provides a separable tag 38 formed of the name and address space 28, as illustrated in FIG. 4.

Figure 4:
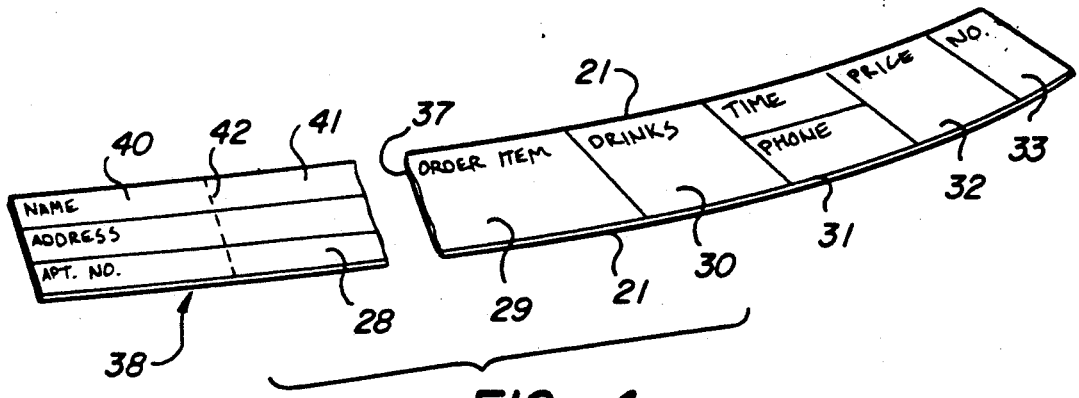
FIG. 4 is a perspective view of the separated delivery address tag and receipt sections of one of the strips.
Figure 5:
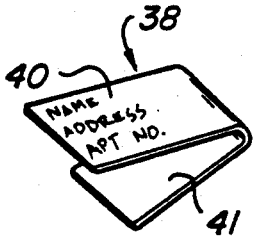
FIG. 5 is a perspective view of the folding of the delivery tag.
Figure 6:
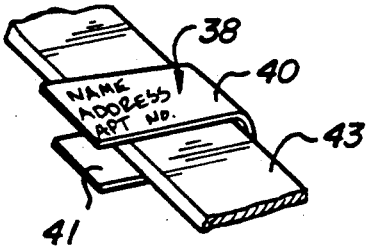
FIG. 6 illustrates the folded tag secured by a band.
Figure 7:
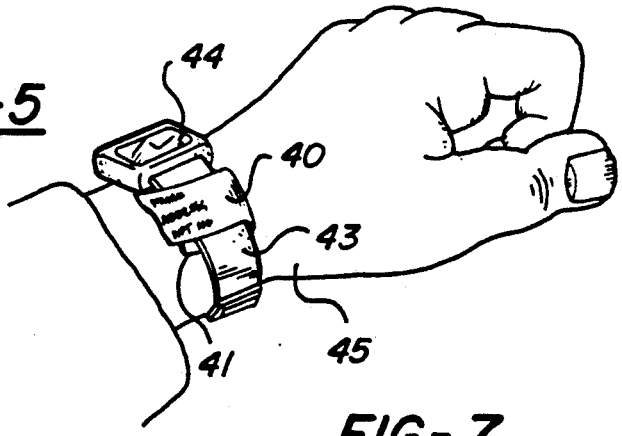
FIG. 7 is a perspective view showing the delivery tag mounted upon a wristwatch band of the delivery driver.

The name and address tag 38 is divided into two parts, namely, upper flap portion 40 and lower flap portion 41 by bending the tag into a U-shape along a line 42 (see FIG. 4). The flap portion 40 forms an upper, exposed flap upon which the name, address, apartment number and other relevant information concerning the delivery destination is written. The other flap 41 forms a lower flap which is used for fastening the tag 38 upon a band 43 (see FIG. 6) which may be the band of a wristwatch 44 that encircles the delivery person's wrist 45 (see FIG. 7). Optionally, the flap 41 could be held beneath a band encircling a portion of an automotive vehicle steering wheel or encircling a portion of a bicycle handlebar or the like. In either event, the delivery man can position the tag 38 in a readily visible location, preferably upon his own wrist, so that he may glance at the address during the delivery operation without searching for the address upon or within the container in which the order is packaged.

In operation, when an order, such as for a pizza and a soft drink, is phoned to the food service, the order taker writes the information concerning the order upon the multi-sheet form along one strip. The information remains with the upper sheet 11, which is kept as a record. The information is simultaneously recorded upon a set of strip sheets, by means of the carbon-like operation of the sheets. After recording the order information, the order taker tears the particular set of strips free from the form along the perforated tear line 20. The three strips in the set temporarily remain together because of the adhesive 25.

Next, in processing the order, one strip may be pulled free from the adhesive, and given to the cook or baker or other food preparer for filling the order. Another strip may be used either for preparing other items or for other purposes in processing the order. The strip 12 with the tear-off tag 38 may be attached to the container, such as a bag or box, in which the order is enclosed or otherwise associated with the delivery. The tag 38 is torn from its strip along its tear line 37 and is given separately to the delivery person. The delivery person folds the tag in half, inserting one flap beneath his own wristwatch band or other appropriate band and then travels to make the delivery.

During the time the delivery is in process, the delivery person may glance at the name and address and other location information on the readily viewable tag, without having to cast his eyes upon the full strip or upon any of the other information or data, which may appear on the order container. As a practical matter, the delivery person is not required to take his eyes off the road, other than momentary glances, in obtaining the information required for the delivery.

In cases where more than one delivery is made simultaneously, the delivery person may place a group of delivery tags beneath his watchband or a band on his steering wheel or bicycle handlebar or the like or may insert the tags beneath his watchband, etc., one at a time, following each delivery.

The rearrangement of the location of the customer's name and address and delivery information upon the end of the information strip and arranging that space so that it may be easily torn away to form a separate tag substantially expedites the delivery because the delivery person need not fumble for, or spend time looking at, the delivery address. This reduces any hazards resulting from the delivery person removing his eyes from the road from time to time to check the address.

This invention may be further developed within the scope of the following claims.

Accordingly, having described an operative embodiment of this invention, I now claim:

1. In a pizza-type delivery, multi-sheet form, used for recording and delivering orders for pizza and other food and non-food items, constructed of a stack of overlapped, aligned sheets that are joined together along one common edge thereof, with said sheets provided with means for transferring information written upon the uppermost sheet through the stack to the successive lower sheets, and with overlapped, aligned printed columns formed on the sheets to provide overlapped, aligned spaces thereon for receiving handwritten order and delivery information, such as the items ordered, the customer's name and address, prince data and the like information; and with one of the sheets of the stack being substantially monolithic to form a record sheet, and with other sheets in the stack being formed as strip sheets; with the strip sheets each being cut transversely to said one edge into substantially uniform, narrow, elongated strips, and with each strip having the aligned information spaces formed thereon so that each strip receives a copy of the order and delivery information for a single order and to form an overlapped set of strips; and with the overlapped set of strips being separably into individual strips from each other and from along said common edge to which the sheets are joined, the improvement comprising:

the space provided by the printed columns for receiving the delivery information being arranged adjacent one end of the sets of strip, that is, along one side of the overlapped sheets so as to form an elongated, address receiving portion extending inwardly from one end of the strips toward the middle of the strips;

and with the delivery address space portion of one of the strips in each set being separated by a tear line means which enables said delivery address space portion to be manually separable from its strip so that the separate address space portion may be carried separably from its respective strip and from the order during delivery of the order in a location readily accessible to the delivery person and the remainder of its strip may remain with the order items or elsewhere.

2. In a construction as defined in claim 1 and said elongated delivery address space portions being of roughly twice the length needed for recording the delivery information and with the manually separable strip space portion being foldable, roughly into two overlapping flaps, namely, an inner flap and an outer flap with the address written upon the outer flap so that the inner flap may be positioned, as a holder, beneath a holding means which exposes the address information on the outer flap to the view of the delivery person during the travel time and delivery operation.

3. A construction as defined in claim 2 and with said inner flap being adapted for positioning beneath a wristband worn by the delivery person for positioning the outer flap over the wristband for viewing by the delivery person of the delivery address written thereon.

4. A construction as defined in claim 3 and including a transverse, perforated tear line formed on the strip sheet having the separable delivery address portion at the inner end of such portion, with respect to its sheet, so that the said address portion may be readily, manually severed from its respective strip.

5. In a construction as defined in claim 4 and including the remainder of the strip from which the delivery address portion is severed being adapted to be positioned upon the order container and serving as a receipt for the customer.

6. In a construction as defined in claim 4 and including said delivery address strip portion being arranged adjacent said common edge where the sheets are joined together.

7. In a construction as defined in claim 6 and including a perforated tear line formed on each of the strip sheets along the common edge where the sheets are joined together with the monolithic sheet, and with the perforated tear line for separating the address portion from its respective strip being located nearer to said common edge tear line than the opposite edge of the strip.

8. In a method for recorded and handling information received from a customer for an order of food or non-food items to be delivered to the customer, which includes providing a multiple sheet form made of a stack of sheets which are joined together along one common edge at a tear line and which are severed, transversely to said edge, into elongated, narrow strips arranged in sets of multiple strips, and with the sheets bearing printed columns which separate the sheets and their aligned strips, into aligned, overlapping spaces for receiving predetermined information, such as the items ordered, price, delivery address and the like, and wherein the sets of strips are removed, one at a time from the stack so that each strip in its set may be separately used for information and record purposes, the improvement comprising:

forming an elongated, narrow, address space portion along one end of each of the strips;

forming a second tear line on one of the sheets parallel to the edge where the sheets are joined together, with the tear line in alignment with one edge of said address space portion;

writing the delivery address in said address space in roughly one half of the address space;

separating the strips and thereafter severing the address space portion, at the tear line, from its respective strip;

folding the severed address space portion into overlapping upper and lower flaps, with the address information on the exposed surface of the upper flap;

positioning the lower flap beneath a holding means with the upper flap arranged upon the holding means so that its information is exposed to the view of a delivery person while delivering the order.

9. In a method as defined in claim 8 and including forming said tear line on said one sheet near the common edge where the sheets are joined together so that the address information space portion is arranged between the common edge and the tear line formed on said sheets.

10. In a method as defined in claim 8 and including inserting the lower flap beneath a band worn on the delivery person's wrist and positioning the upper flap over the exposed surface of the band so that the delivery address information is readily visually accessible to the delivery person while making the delivery.

* * * * *